United States Patent [19]

Weston

[11] 3,990,641

[45] Nov. 9, 1976

[54] CRYOGENIC FEED METHOD AND APPARATUS ESPECIALLY FOR WIRE

[75] Inventor: Billy J. Weston, Chicago, Ill.

[73] Assignee: Jeno, Inc., Skokie, Ill.

[22] Filed: Mar. 3, 1975

[21] Appl. No.: 555,024

[52] U.S. Cl. ..... 241/17; 241/23; 241/65; 241/DIG. 37

[51] Int. Cl.[2] ..... B02C 23/18

[58] Field of Search ..... 241/17, 23, 65, DIG. 37; 259/3; 165/81, 82, 89; 62/63, 304, 374, 380, 465

[56] References Cited

UNITED STATES PATENTS

| | | | |
|---|---|---|---|
| 2,879,005 | 3/1959 | Jarvis | 241/DIG. 37 |
| 2,964,184 | 12/1960 | Gillette | 241/DIG. 37 |
| 2,977,255 | 3/1961 | Lowry | 241/17 |
| 3,185,192 | 5/1965 | Delcellier | 241/178 |
| 3,446,030 | 5/1969 | Rubin | 62/63 |
| 3,512,581 | 5/1970 | Lawton | 165/81 |
| 3,771,729 | 11/1973 | Frable | 241/DIG. 37 |

*Primary Examiner*—Granville Y. Custer, Jr.
*Attorney, Agent, or Firm*—Silverman & Cass, Ltd.

[57] ABSTRACT

Method and apparatus for separating metallic conductor wire from its insulation for reclamation of the metal and secondarily the insulation material. Random-size, non-uniform masses and pieces of the insulated wire are conveyed to an entrance end of a shaftless rotatable drum having helically deployed baffles along the inner surface thereof. The masses and pieces introduced to the drum initially and continuously are exposed therein to cryogenic coolant to freeze the same and render them brittle. The baffles continuously turn the frozen masses and pieces to ensure that all surfaces and areas thereof are exposed to the coolant for thorough freezing. Simultaneously, the action of the baffles and drum move the masses and pieces from the entrance end to an exit end of the drum. The super-cooled brittle masses and pieces are delivered from the exit end to a grinding apparatus where the same are reduced to particles of metal and insulation material. Thereafter, the particles are moved to a separating apparatus for separate accumulation of ground metal and insulation.

The drum is mounted in a cage formed by longitudinal rods extending the length thereof and transverse posts between the rods and the exterior surface of the drum such that physical connection between the drum and cage is minimal and present only at the post ends terminating on the drum surface. The minimal drum and cage connection permits drastic expansion and contraction of the drum during introduction of cryogenic material therein without hindering mechanical operation of the drum.

22 Claims, 6 Drawing Figures

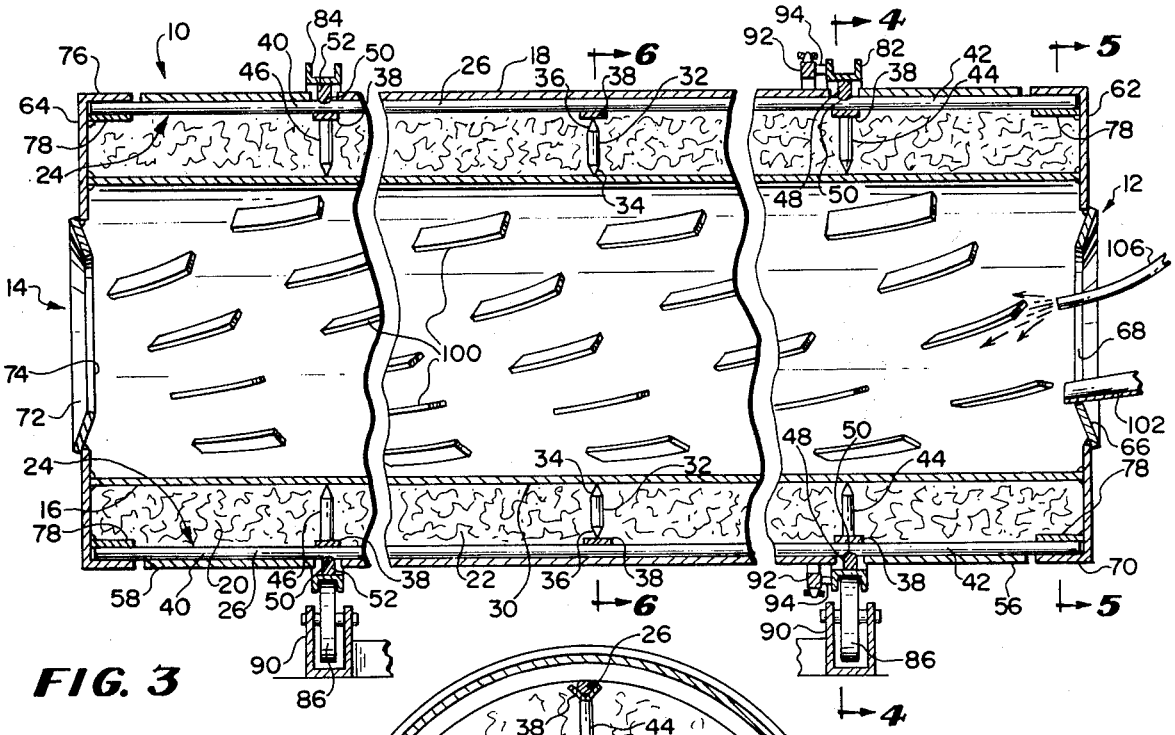
FIG. 3
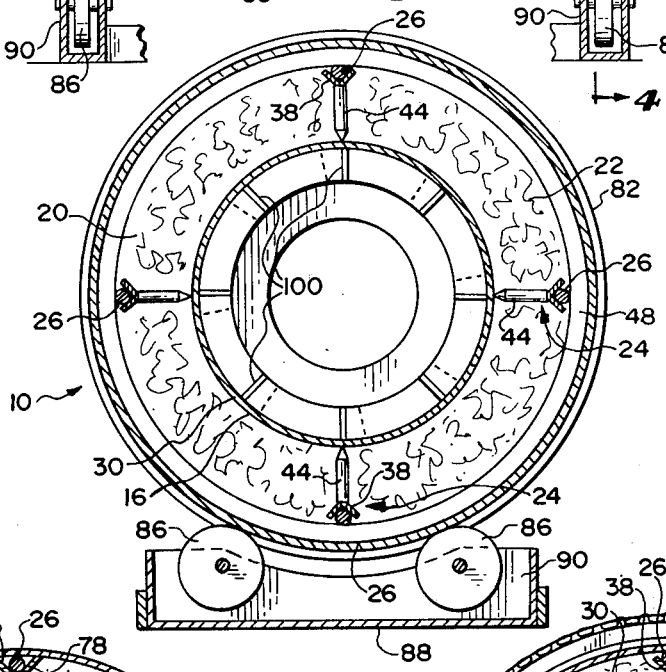
FIG. 4
FIG. 5
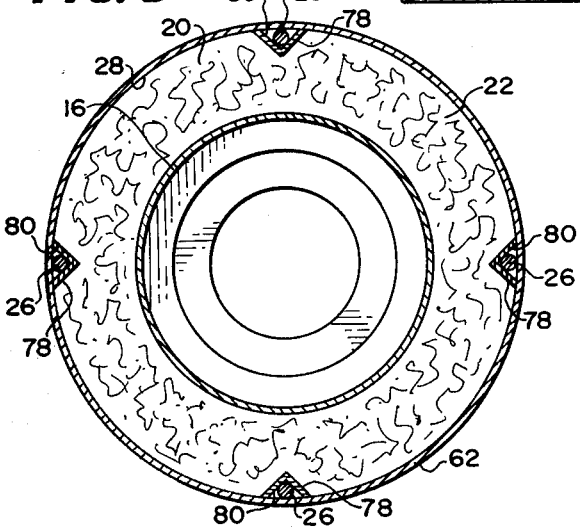
FIG. 6
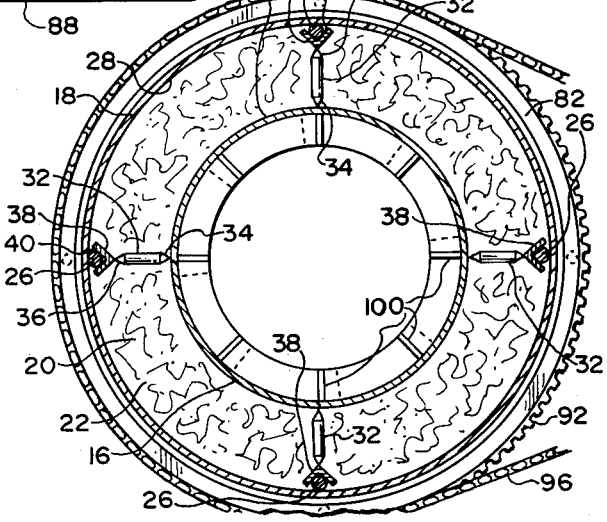

CRYOGENIC FEED METHOD AND APPARATUS ESPECIALLY FOR WIRE

BACKGROUND OF THE INVENTION

1. Field of the Invention

This invention relates generally to the separation of wire-insulating material from its wire, and more particularly, to a method and apparatus for freezing random-size masses and pieces of insulated wire in a shaftless rotatable drum and thereafter grinding the same to produce small-size particles to be separated.

2. Description of the Prior Art

The desirablity of recovering metal and insulation materials from scrap and otherwise discarded conductor wire is well-known. The value of copper which can be recycled is the prime reason for performing such recovery operation. Recovery of other metals such as aluminum, brass and iron also is desirable. The insulation materials on such wire also have value when recovered for use as pulverized filler for packaging and other uses.

Various methods and apparatus are known for performing the recovery operation. In one process, the wire with insulation thereon is burned to eliminate the insulation. The burning method has disadvantages in that it creates impurities from the insulation which contaminate the metal, it makes recovery of the insulation impossible, and most importantly, it results in generation of highly toxic gases which heretofore have been released into the atmosphere with resultant pollution. In an effort to prevent atmospheric pollution, water scrubber devices have been used to eliminate the toxic gases before they are released, but this procedure results in pollution of the water with equal disadvantage. Current environmental protection laws render the burning method not only undesirable, but for the most part illegal.

Another method used heretofore to effect recovery of conductor metal and insulation is to grind or pulverize scrap pieces of wire by use of mills, crushers, rollers and the like. This method obviates the pollution problems attendant with burning processes, but results in other disadvantages. Conductor wire, such as copper, is very malleable at ambient termperature. Large masses, lengths or pieces of such wire tend to jam grinding mills because they are not readily broken-up. When grinding processes per se are used, therefore, the wire to be treated must usually first be reduced to small size pieces or lengths in effort to minimize such jamming of the grinding apparatus. Large masses, lengths, and coils of wire generally cannot be processed in grinding mills until they are first straightened and passed through chopping devices to reduce the same to small lengths or pieces and thereafter ground. These operations use substantial amounts of energy, are time-consuming and often are not successful in preventing jamming of the grinding apparatus.

Attempts have been made to use cryogenic materials such as liquids and gases during treatment of the wire to be separated from its insulation by exposing the wire to the cryogenic material during or immediately prior to the grinding operation. When super cooled, the wire and insulation is rendered brittle. The brittle wire presents much less resistance to a grinding apparatus than wire at ambient temperatures; consequently, the grinding is accomplished faster, with less energy consumption, and with reduced jamming effect on the grinding apparatus.

Prior art structures incorporate the use of conveyors onto which wire scraps and bundles are placed and passed through a cooling unit where the wire is exposed to a cryogenic chemical to freeze the same. The frozen wire passes out of the cooling unit to a grinding or crushing station where grinding and separation of the insulation from the wire is effected. Such processes are disclosed in U.S. Pat. Nos. 3,527,414, 3,647,149 and 3,666,185. To be effective, freezing of the conductor wire masses and pieces must be complete, i.e., all surfaces and internal areas of the wire must be totally frozen. Where conveyor systems such as those disclosed in the aforementioned patents are used, the freezing operation may not result in total penetration of the wire to be treated because the coolant may not reach all surfaces of the wire, such as the undersides thereof resting on the conveyor. It is possible to ensure total freezing of the wire by increasing the time the same is conveyed through the coolant, i.e., by using an extra long conveyor, but such systems would be impractical because of space limitations.

The desired freezing of wire to be ground and separated from its insulating ideally is performed in a rotatable drum into which masses of wire in any volume, size or shape can be placed and exposed to cryogenic material. A drum in which the wire is introduced will continually turn the same for exposure of all surfaces and areas to the coolant. Consequently, total freezing as desired can be accomplished with certainty and in a relatively limited space area. Furthermore, because coolant introduced into a rotating drum will continually contact the wire to be frozen, the amount of coolant required for total freezing will be less than that needed when conveying systems are used.

Presently existing drum designs and constructions do not permit exposure therein of articles to cryogenic materials for several reasons. In the case of a typical drum rotatably mounted on a central shaft with one or more paddle wheels on the interior of the drum to effect simultaneous tumbling and movement of articles therethrough, the pieces of wire to be treated must first be reduced to small lengths because large pieces tend to wrap around the shaft and paddles as they are being agitated. The problem is compounded when the wire is frozen because it then becomes exceedingly difficult to free the frozen wire from the drum to unclog the same. Furthermore, the cryogenic material used, which typically is nitrogen in a liquid atomized state at very low temperatures around −50° C, causes the drum to freeze also and therefore contract since the drum is formed of metal. The contraction of metal when exposed to cryogenic materials and resultant extremely low temperature can be drastic and will have a serious effect on the mechanical operating characteristics of the drum and its drive mechanism. Metal-on-metal parts will freeze making use of the cryogenic material impractical as well as undesirable.

SUMMARY OF THE INVENTION

The invention provides a method and apparatus for separating metallic conductor wire from its insulation comprising feeding masses of random size and shaped insulated wire into a shaftless rotatable drum having generally helically arranged baffles along the inner surface thereof for continuously turning and moving the wire from an entrance end to an exit end thereof and simultaneously totally freezing the wire at the entrance end of the drum and throughout its movement therethrough with a cryogenic material to render the insulated wire brittle and thereafter grinding the frozen wire into small-sized particles and separating the ground metal and insulation. The apparatus of the invention comprises an elongate shaftless drum mounted in a cage formed by longitudinal rods extending the length thereof and transverse posts between the rods and the exterior surface of the drum such that physical connection between the drum and cage is minimal and present only at the post ends terminating on the drum surface. The minimal drum and cage connection permits drastic expansion and contraction of the drum during introduction of the cryogenic chemical therein without hindering mechanical operation of the drum.

BRIEF DESCRIPTION OF THE DRAWINGS

FIG. 3 is a partial longitudinal sectional view taken through the apparatus of FIG. 2;

FIG. 4 is a sectional view taken along the line 4—4 of FIG. 3 in the direction indicated generally;

FIG. 5 is a sectional view taken along the line 5—5 of FIG. 3 in the direction indicated generally; and FIG. 6 is a sectional view taken along the line 6—6 of FIG. 3 in the direction indicated generally.

DESCRIPTION OF THE PREFERRED EMBODIMENT

Figure 1:
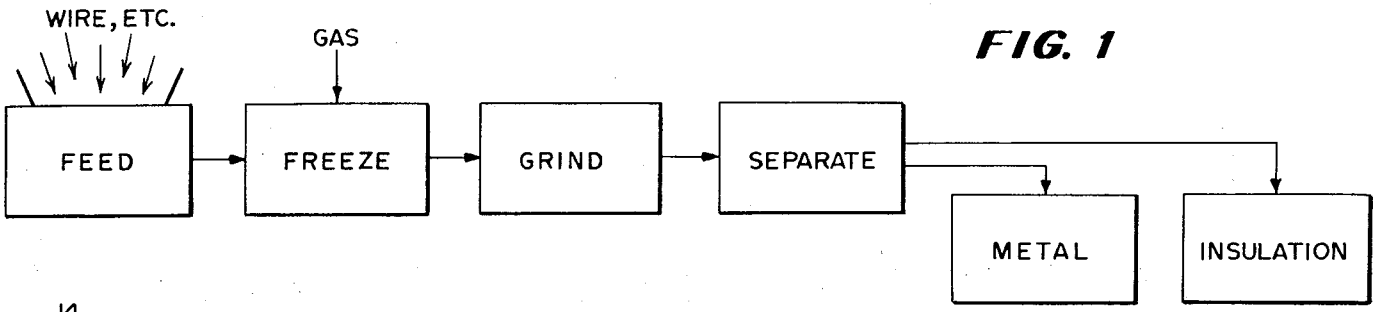
FIG. 1 is a block diagram showing the several steps of a process for separating metallic conductor wire from its insulation.

The apparatus 10 of the invention is of generally elongate cylindrical configuration with an entrance end 12 and an exit end 14. An inner drum 16 preferably formed of stainless steel is retained within an exterior sheet metal shell 18 to form a cylindrical chamber 20 between the drum and the shell. The chamber 20 is packed with insulation material such as polyeurethane foam 22 to insulate the drum from the shell.

The drum 16 is supported in position spaced from shell 18 by a cage 24 formed of a plurality of rods 26 extending substantially the length of the drum and abutting the inner surface 28 of exterior shell 18. In the embodiment shown, there are four such rods 26 spaced equi-distantly around the circumference of the drum 16, but there could be more or less rods if desired. A steel post 32 is positioned between each rod 26 and the exterior surface 30 of drum 16 proximate the mid-point of the length thereof. Each post 32 is formed at both ends thereof with reduced area pointed tip portions 34, 36 respectively. Each tip 34 of posts 32 in contact with drum 16 is spot welded to the drum for connection therewith, but to a minimal degree. Each tip 36 at the end of rods 32 opposite tip 34 is spot welded to the undersurface of a generally V-shaped bracket 38, there being one such bracket for each post 32. The open channel portion 40 of each bracket 38 forms a receiving cradle within which a rod 26 rests. There is no weldment or other securement between rods 26 and channel portions 40 of brackets 38.

Each rod 26 is similarly supported at two additional locations proximate the respective ends 40, 42 thereof. Thus, there is a post 44 between each rod and the external surface 30 of drum 16 proximate the entrance end 12 thereof; and there is a post 46 likewise positioned proximate the exit end 14 of the drum. Each post 44, 46 is formed with reduced area tips similar to the tips of posts 32 and is spot welded to the drum for minimal connection therewith. Additionally, positioned between each post 44, 46 and the rods 26 is a V-shaped bracket 38 as described above, and rods 26 are cradles in these brackets in the same manner as described.

The ends of each rod 26 proximate the intersection thereof with posts 44 are rigidified by a circular web 48 concentric with drum 16 and welded to the rods at points 50. The web 48 extends radially outward a small distance beyond shell 18. Likewise, the ends of each rod proximate the intersection with posts 46 are rigidified by a comparable web 52 welded to the rods. The bars, rods and two webs welded to the bars form the previously mentioned cage 24 which retains the drum within the shell 18. The shell 18 is wrapped around the cage 24 to protectively cover the same and the insulation material 22; the shell is secured in place by fasteners passing through apertured flanges 54 along the abutting edges of the shell.

The respective ends 40, 42 of the rods 26 are covered and protected by short removable cylindrical shrouds 56, 58 wrapped around either end in the same fashion as shell 18, and secured in place by fasteners passing through flanges 60. Shroud 56 extends from a location adjacent web 48 to the entrance end 12 of the apparatus; shroud 58 extends from a location adjacent web 52 to the exit end 14 of the apparatus. The insulating material 22 is packed within the chamber 20 formed by each shroud surrounding the opposite ends of drum 16.

For purposes of closing off the respective ends of apparatus 10, each end is provided with a cap member. A cap 62 is positioned over entrance end 12 and a similar cap 64 is positioned over exit end 14. Cap 62 includes a circular collar 66 forming entrance mouth 68 to permit introduction into the apparatus of material to be treated. A circumferential flange 70 extending over rods 26 is formed integral with the cap and terminates proximate shroud 56. Similarly, cap 64 includes a collar 72 to form exit mouth 74 for exit of the treated material, and a circumferential flange 76 extending over rods 26 terminating proximate shroud 58.

Each cap 62, 64 is provided on the inner surface thereof with generally V-shaped brackets 78 to support the terminal ends of each rod 26. Thus, in the embodiment shown, there are four such brackets 78 secured on the inner surface of each cap, one such bracket for each rod. Brackets 78 are welded to their respective caps but there is no permanent connection between a rod and the cradle portion 80 of each bracket within which the rod rests. As is best seen in FIG. 3, each rod 26 is supported along its length by brackets 78 at either end thereof, bracket 38 proximate the center of the rod, and additional brackets 38 positioned between the central bracket and the end brackets 78. The rods 26 are not secured within the bracket cradles and therefore are free to slidably move upon the brackets relative to the drum 16 longitudinally.

A pair of support rings 82, 84 is circumferentially secured around the apparatus at respective locations above each web 48, 52. Each ring has a generally channel-shaped cross-sectional configuration with open channel portion facing radially outward of the apparatus. Rollers 86 are mounted on a platform 88 in brackets 90 at the bottom of the apparatus to engage the rings and support the weight of the apparatus. A large ring gear 92 is secured to support ring 82 upon a circumferential extension 94 thereof. A chain 96 engages the ring gear and a motor 98 to provide for rotation of the entire apparatus 10.

Figure 2:
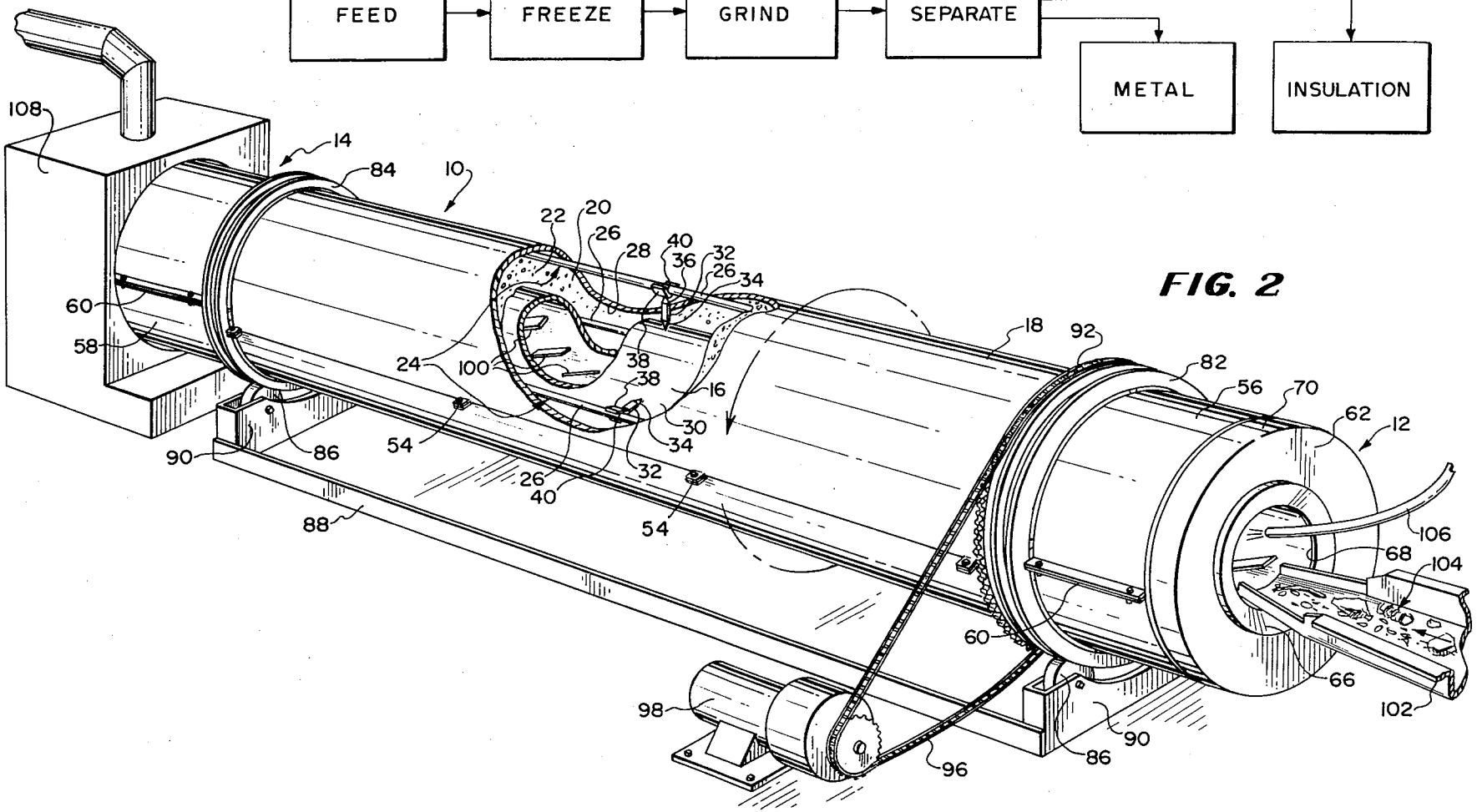
FIG. 2 is a perspective view, partially broken away, of a rotatable drum apparatus for performing the process of the invention.

As stated above, drum 16 preferably is a stainless steel cylinder which is continuous throughout its length. A plurality of radially inward extending baffles 100 are welded along the interior of the drum along a generally helical line originating at entrance end 12 and terminating at exit end 14. The baffles are formed of arcuate rectangular cross-section stainless steel members and serve to work any mass of material introduced to the drum at the entrance end toward the exit end while the drum is rotating. A conveyor 102 is shown in FIG. 2 to feed such masses of material, particularly insulation-coated wire 104, into entrance mouth 68 where the same will be so worked or moved to exit end 14 while the apparatus 10 is rotated.

As described thus far, the apparatus 10 is a combination conveyor-agitating device for moving scrap metals from a feed station (conveyor 102) to grinding and separating stations (beyond exit end 14 and not shown) while at the same time turning or agitating the scrap by reason of the interaction of the baffles 100 therewith while the apparatus is rotating. Such an agitator-conveyor is useful in breaking up for further processing masses of metals which are brittle under ambient temperatures and have relatively low resistance to fracture, such as brass covered with hard rubber or other ceramic covered metals. The apparatus 10 is useful interchangeably to treat generally malleable metals, such as copper conductor wire with plastic insulation thereon, with cryogenic materials prior to processing thereof in a grinding mill. In the latter case, the copper conductor wire will be rendered brittle by exposing the same to such cryogenic material, i.e., nitrogen in a liquid atomized state. The structure of apparatus 10 is such as to permit the enormous expansion and contraction occasioned by lowering the temperature inside of drum 16 to below zero in order to maintain copper conductor wire in a frozen state.

In operation while being exposed to cryogenic materials, copper conductor wire 104 is fed to mouth 68. Because there is no central shaft or paddles on the interior of drum 16 on which wire scraps will catch, the wire 104 need not be chopped up to small pieces but can be of virtually any length, shape, size or mass; even large tangled coils, bales and blocks of scrap wire may be supplied to apparatus 10 for processing. While wire 104 is being fed into drum 16, nitrogen in liquid form also is introduced into mouth 68, such as by atomizing spray conduit 106. The wire 104 introduced into mouth 68 is immediately caught and tossed by baffles 100 which simultaneously tumble and turn the wire within the drum, agitate the same and move it through the drum from the entrance end 12. All surfaces and areas of the wire thereby are exposed to the nitrogen also introduced to the drum. Consequently, total and continuous freezing of the wire is effected with certainty before the wire passes out of the drum. The wire is rendered brittle by the freezing process and even casual breaking-up thereof occurs by reason of the continuous impact thereon by baffles 100 and by falling on itself as the wire moves to exit end 14. The frozen, brittle wire exits from apparatus 10 into a chamber 108 from which it is fed to a grinding mill indicated in FIG. 1. The brittle wire is readily ground in the mill because of its relatively low impact resistance; jamming and clogging of the mill as well as energy demands upon the mill are minimized. The ground wire metal and insulation next is moved to a separating apparatus such as a vibrating platen where the heavier metal is separated from the insulation. The separated ground metal and insulation thereafter is accumulated to complete the recovery process.

The construction of cage 24 is such as to permit the drastic contraction of drum 16 when frozen without hindering mechanical operation of the apparatus 10. In a typical apparatus which is 16 feet in length, having an outer diameter of 32 inches and an inner diameter of 20 inches, the drum 16 may expand or contract as much as one-half inch. Since the only physical contact between the drum and cage 24 is at the tips 34 of posts 32, 44 and 46, and the posts are not rigidly secured to rods 26, the cage will not be affected by contraction of the drum. Even if some of the extreme cooling of the drum is transferred to the cage 24, the apparatus is self-compensating since the posts may move moderate distances longitudinally of the rods, and the rods may likewise move in the cradles of brackets 78.

Apparatus 10 may be used to recover other types of scrap metals which preferably are pre-frozen to enhance breaking-up treatment. For example, it is desirable to recover cast iron from engine blocks which heretofore have had to be immersed in a nitrogen bath to freeze same prior to a grinding operation. The drum 16 could be constructed of appropriate length and inner diameter to receive such engine blocks which would be treated in the drum to render the same frozen and brittle in the same manner as described above in connection with wire 104.

Complete electric motors and generators could be processed in apparatus 10 in a similar manner and, after freezing, crushed and the metallic components separated from the non-metallic components.

What it is claimed and desired to secure by Letters Patent of the United States is:

1. A method of recovering metal from scrap of random shape and size which comprises:

A. mechanically reducing the physical size of the scrap if required to feed the same into a generally horizontally arranged transport area including an elongate shaftless rotating drum, B. moving the scrap forward through the drum from the entrance end of said drum to the exit end of said drum while simultaneously 1. tumbling the scrap continuously,
2. subjecting said drum and the scrap to cryogenic material, and
3. substantially confining the drum including the entrance and exit ends thereof, whereby to embrittle the scrap, C. grinding the scrap after it leaves the exit end while it is still brittle and D. separating the metallic and non-metallic components after grinding.

2. A method as claimed in claim 1 in which the cryogenic material to which the scrap is subjected is nitrogen in a liquid atomized state.

3. A method as claimed in claim 1 in which the scrap is at least casually broken-up during the step of moving.

4. A system for recovering metal from scrap of random shape and size comprising:

A. a shaftless rotable elongate drum having an entrance end for recipt of the scrap therein, means for introducing cryogenic material to the drum and the scrap therein, B. agitating means positioned along the inner-facing surface of the drum for continuously tumbling the scrap therein and moving it through the drum to an exit end thereof, C. drive means for imparting rotative movement to the drum, D. grinding means for receiving the scrap at the exit end and grinding the same to small-size elements, and E. separating means for receiving the ground scrap and separating the metallic and non-metallic components thereof.

5. A system as claimed in claim 4 in which the drum includes a support cage for retaining the drum therein and the drive means are operative on the cage.

6. Apparatus for moving and agitating random shaped and sized scrap in a system for recovering the metal therefrom comprising:

A. a shaftless rotatable elongate generally horizontally arranged drum having an entrance end for receipt of the scrap therein, B. agitating means positioned along the inner-facing surface of the drum for continuously tumbling the scrap therein and moving it through the drum to an exit end thereof, C. a support cage for retaining the drum therein, and D. drive means for imparting rotative movement to the drum.

7. Apparatus as claimed in claim 6 in which said cage comprises:

A. a plurality of elongate rods positioned around the external surface of the drum and extending substantially the length thereof, B. at least one radially disposed post secured between each rod and the exterior surface of the drum, and C. a pair of circular webs concentric with the drum joining the rods, there being one such web positioned proximate the respective ends of the rods.

8. Apparatus as claimed in claim 7 in which said posts are positioned proximate the mid-points of their respective rods, the cage including two additional posts radially diposed between each rod and the drum, there being one such post positioned proximate each respective end of the drum adjacent a respective web joining the rods.

9. Apparatus as claimed in claim 8 including a generally V-shaped bracket positioned between each post and its respective rod, the open ends of said brackets forming cradles for receipt of said respective rods, said rods being free to slidably move within said cradles relative to the drum longitudinally.

10. Apparatus as claimed in claim 8 in which each post is formed at its end in contact with the drum with a reduced area tip portion and the tip portion is spot welded to the drum.

11. Apparatus as claimed 7 in which the rods are four in number.

12. Apparatus as claimed in claim 6 including a cylindrical shell formed around the cage and drum, said shell defining a chamber between the shell and the drum, and insulation material disposed within the chamber.

13. Apparatus as claimed in claim 7 including respective cap members covering the entrance and exit ends of the drum, the cap covering the entrance end having a circular collar forming an entrance mouth for the drum, each cap member having a circumferential flange extending over the drum and the ends of the rods.

14. Apparatus as claimed in claim 13 in which each cap is formed on the drum-facing side thereof with a plurality of generally V-shaped brackets, there being one bracket on each cap for each rod, and the open ends of said brackets form cradles for receipt of a respective rod.

15. Apparatus as claimed in claim 14 in which the rods are free to slidably move within said cradles relative to said drum longitudinally.

16. Apparatus as claimed in claim 6 including a pair of support rings circumferentially secured around the cage, there being one such ring positioned proximate the respective ends of the rods, each ring being of generally channel-shaped cross-sectional configuration with the open channel portions thereof facing radially outwardly of the drum, and a plurality of rollers engageable in said channel portions to support the drum but permit rotative movement thereof.

17. Apparatus as claimed in claim 16 including a ring gear secured to one of said support rings, and a chain engaging the gear and a motor to drive the drum.

18. Apparatus as claimed in claim 6 in which the drum is formed of continuous stainless steel throughout its length.

19. Apparatus as claimed in claim 6 in which said agitating means comprise a plurality of radially inward extending baffles formed of arcuate rectangular cross-section members.

20. Apparatus as claimed in claim 19 in which the baffles are positioned along a generally helical line originating at the entrance end and terminating at the exit end.

21. Apparatus as claimed in claim 6 including means for introducing cryogenic material at the entrance end to freeze the scrap as it is introduced to the drum and render the same brittle.

22. Apparatus as claimed in claim 21 in which the cryogenic material is nitrogen in a liquid atomized state.

* * * * *